US006494224B2

(12) United States Patent
Zheng

(10) Patent No.: US 6,494,224 B2
(45) **Date of Patent: *Dec. 17, 2002**

(54) COLLAPSIBLE STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/954,323

(22) Filed: Sep. 17, 2001

(65) Prior Publication Data

US 2002/0029795 A1 Mar. 14, 2002

Related U.S. Application Data

(63) Continuation of application No. 09/349,566, filed on Jul. 8, 1999, now Pat. No. 6,289,910.

(51) Int. Cl.[7] ..... E04H 15/44

(52) U.S. Cl. ..... 135/125; 135/126; 135/128; 135/143

(58) Field of Search ..... 135/124, 125, 135/126, 128, 130, 143, 144

(56) References Cited

U.S. PATENT DOCUMENTS 5,385,165 A 1/1995 Hazinski et al.
5,560,385 A 10/1996 Zheng
5,592,961 A 1/1997 Chin
5,601,105 A 2/1997 Blen et al.
5,618,246 A 4/1997 Zheng
5,645,096 A 7/1997 Hazinski et al.
5,676,168 A 9/1997 Price
5,778,915 A 7/1998 Zheng
5,800,067 A 9/1998 Easter
6,289,910 B1 * 9/2001 Zheng ..... 135/125
6,357,510 B1 * 3/2002 Zheng ..... 135/143
6,360,761 B1 * 3/2002 Zheng ..... 135/126
6,390,111 B2 * 5/2002 Zheng ..... 135/126

* cited by examiner

*Primary Examiner*—Daniel P. Stodola
*Assistant Examiner*—Erica B. Harris
(74) *Attorney, Agent, or Firm*—Raymond Sun

(57) ABSTRACT

A collapsible structure has a base panel that includes separate first and second sides, a foldable frame member having a folded and an unfolded orientation, and a fabric material covering portions of the frame member to form the base panel when the frame member is in the unfolded orientation. The structure also includes first and second loops, each loop having a foldable frame member having a folded and an unfolded orientation. The first side of the base panel is coupled to the first loop, and the second side of the base panel is coupled to the second loop.

10 Claims, 15 Drawing Sheets

COLLAPSIBLE STRUCTURES

This is a continuation of application Ser. No. 09/349,566, filed on Jul. 8, 1999, entitled "Collapsible Structures", now U.S. Pat. No. 6,289,910.

BACKGROUND OF THE INVENTION

1. Field of the Invention

The present invention relates to collapsible structures, and in particular, to collapsible structures which may be provided in a variety of shapes and sizes.

2. Description of the Prior Art

Collapsible objects have recently become popular with both adults and children. Many of these collapsible objects have a plurality of panels which may be twisted and folded to reduce the overall size of the object to facilitate convenient storage and use. Each panel is comprised of a fabric or material that is supported by a resilient frame member, with the fabric or material spanning a portion of, or entirely across, the area supported by the frame member. The frame member supports the periphery of each panel, and is capable of being twisted and folded to reduce the size of each panel.

Examples of such collapsible objects are shown and described in U.S. Pat. No. 5,467,794 (Zheng), U.S. Pat. No. 5,560,385 (Zheng) and U.S. Pat. No. 5,778,915 (Zheng) in the form of collapsible structures. These structures are currently being enjoyed by many people in many different applications. For example, these structures have been provided in many different shapes and sizes for children's play indoors and outdoors. Smaller versions of these structures have been used as infant nurseries. Even smaller versions of these structures have been used as dollhouses and action figure play houses by toddlers and children. As another example, these structures have been made into tents or outdoor structures that can be used by adults and children for camping or other outdoor purposes. These structures have also been used as beach cabanas. Even animals can enjoy these structures. Some of these structures have been made into shelters that can be used by pets, both indoors and outdoors. The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structures. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

Another example of collapsible objects includes collapsible game and play structures, such as those illustrated in U.S. Pat. No. 5,722,446 (Zheng) and U.S. Pat. No. 5,816,954 (Zheng). These structures provide a multitude of game structures that can be enjoyed by children and adults indoors and outdoors.

SUMMARY OF THE DISCLOSURE

It is an object of the present invention to provide collapsible objects and structures that are different from those mentioned above, and which offer the user different variety of play and flexibility in use.

In order to accomplish the objects of the present invention, one collapsible structure according to the present invention has a base panel comprising separate first and second sides, a foldable frame member having a folded and an unfolded orientation, and a fabric material covering portions of the frame member to form the base panel when the frame member is in the unfolded orientation. The structure also includes first and second loops, each loop having a foldable frame member having a folded and an unfolded orientation. The first side of the base panel is coupled to the first loop, and the second side of the base panel is coupled to the second loop.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
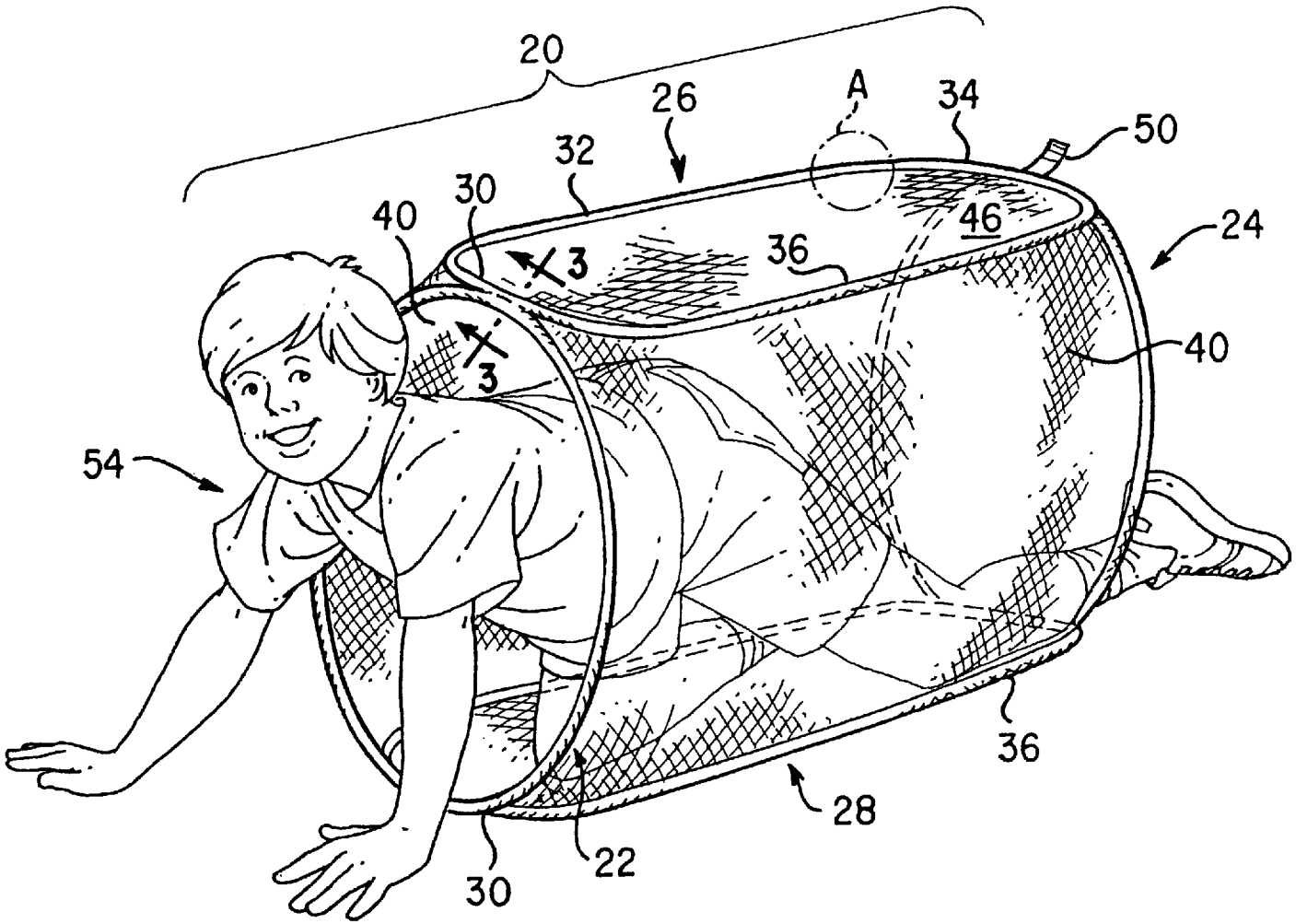
FIG. 1 is a perspective view of a collapsible structure according to one embodiment of the present invention shown in use is expanded configuration.

A basic embodiment of the present invention is illustrated in connection with FIGS. 1–3. This basic embodiment illustrates the basic underlying principles of the present invention, which are applicable to all the other embodiments described hereinbelow. Referring to FIG. 1, a collapsible structure 20 has a first end loop 22 and a second opposing end loop 24 that are separated and coupled by a plurality of panels. In the embodiment of FIG. 1, the structure 20 has two panels 26 and 28. Each panel has four sides, a first end side 30, two lateral sides 32 and 36, and a second end side 34. The first end side 30 of each panel 26, 28 is hingedly connected to the first end loop 22, and the second end side 34 of each panel 26, 28 is hingedly connected to the second end loop 24. In FIG. 1, the panel 28 functions as a bottom panel that is adapted to rest on the ground or surface, and the panel 26 functions as a top panel that is generally opposite and parallel to the panel 28. Fabric 40 can be stitched to the lateral sides 32, 36 of each panel 26, 28 along a stitching 35

(see also FIG. 2 as described below) and to the end loops 22 and 24 to partially or completely cover the sides of the structure 20. The loops 22 and 24 can be positioned generally parallel to each other.

Each panel 26, 28 has a continuous frame retaining sleeve 42 provided along and traversing the four edges of its four sides. As shown in FIG. 2, each sleeve 42 may be formed by folding a piece of fabric and applying a stitching 35 to enclose the sleeve. A continuous frame member 44 is retained or held within each frame retaining sleeve 42 to support each corresponding panel 26, 28. Only one frame member 44 is shown in FIG. 2; the other frame member 44 is not shown but has the same construction. The continuous frame members 44 may be provided as one continuous loop, or may be a strip of material connected at both ends to form a continuous loop. The continuous frame members 44 are preferably formed of flexible coilable steel having a memory, although other materials such as plastics may also be used. The frame members 44 should be made of a material which is relatively strong and yet is flexible to a sufficient degree to allow it to be coiled. Thus, each frame member 44 is capable of assuming two positions, an open or expanded position such as shown in FIG. 1, or a folded position in which the frame member 44 is collapsed into a size which is much smaller than its open position (see FIG. 5E). The frame members 44 may be merely retained within the respective frame retaining sleeves 42 without being connected thereto. Alternatively, the frame retaining sleeves 42 may be mechanically fastened, stitched, fused, or glued to the frame members 44 to retain them in position.

Fabric or sheet material 46 extends across each panel 26, 28, and is held taut by the respective frame member 44 when in its open position. The fabric 46 for a particular panel 26 or 28 is stitched to its corresponding frame retaining sleeve 42. The term fabric is to be given its broadest meaning and should be made from strong, lightweight materials and may include woven fabrics, sheet fabrics or even films and meshed materials. The fabric should be water-resistant and durable to withstand the wear and tear associated with rough treatment by children.

Each loop 22, 24 is essentially made up of a continuous frame member 44 retained or held within a frame retaining sleeve 42. The fabric 46 can extend completely across the space enclosed by the frame member 44 for each loop 22, 24, or can extend across selected portions of the space enclosed by the frame member 44, or the fabric 46 can be completely omitted, such as shown in FIG. 1 for loop 22 which functions to define an opening or ingress or egress.

As set forth above, the first end side 30 of each panel 26, 28 is hingedly connected to the first end loop 22, and the second end side 34 of each panel 26, 28 is hingedly connected to the second end loop 24. Non-limiting examples of the hinged connection will be described below in connection with FIG. 3. As an alternative, the sides 30 and 34 can be removably connected to the loops 22, 24 by a conventional attachment mechanism, such as one or more pairs of opposing velcro pads 50 that are provided along the sides 30, 34 and the circumference of the loops 22, 24. Other conventional attachment mechanisms, such as but not limited to hooks, fasteners, buttons, snap-fit engagements, loops, snap buckles, zippers and ties, can also be used without departing from the spirit and scope of the present invention.

The words "hingedly connected" or "hinged connection" when used herein means permanently connecting or attaching two adjacent sides of adjacent panels or loops in a manner in which the connection is not intended to be dis-connected during normal use of the structure. FIG. 3 illustrates one non-limiting method for hingedly connecting the side 30 to the loop 22. The sleeve 42 of the panel 26, the fabric 46 of the panel 26, and the sleeve 42 of the loop 22 are all directly stitched together by a stitching 52. The stitching 52 can extend along a portion of, or the entire side 30. The stitching 52 also acts as a hinge for the panel 26 and loop 22 to be folded upon each other, as explained below. The hinged connection between the side 34 and the loop 24 can be the same.

Figure 2:
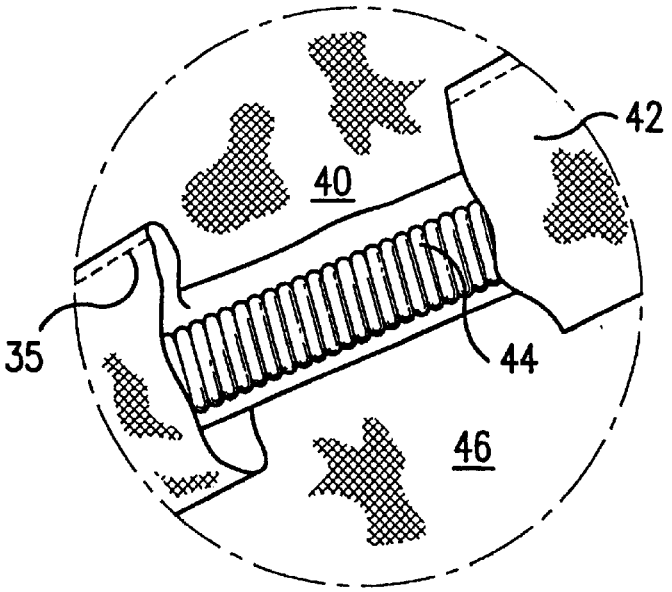
FIG. 2 is a partial cut-away view of the section A of the structure of FIG. 1 illustrating a frame member retained within a sleeve.
Figure 3:
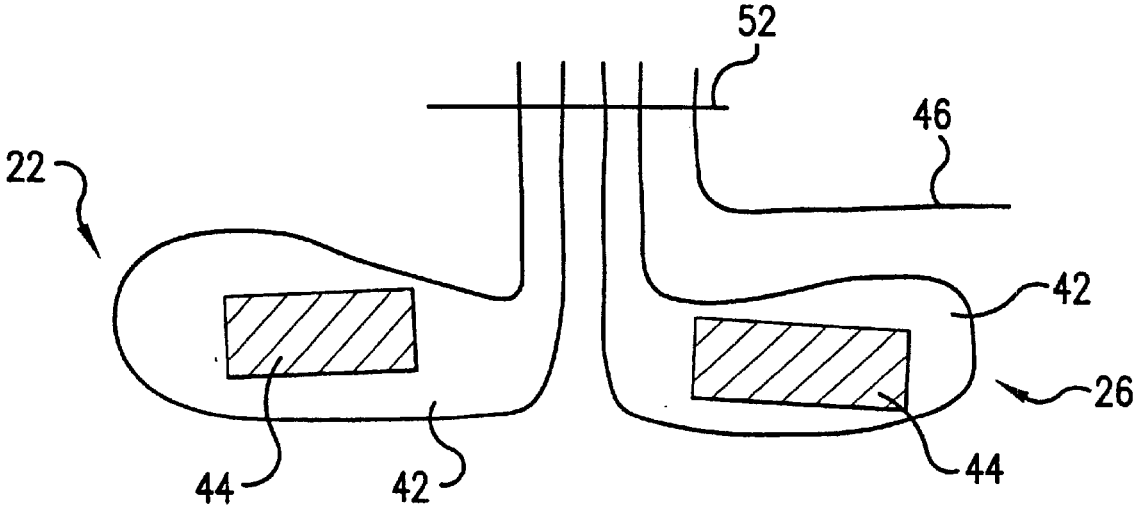
FIG. 3 is a cross-sectional view of a connection between two adjacent panels of the structure of FIG. 1 taken along line 3—3 thereof.

At the sides 32 and 36 of the panels 26, 28 which are not hingedly connected to a loop 22 or 24, FIG. 2 illustrates the connection between the panels 26, 28, their sleeves 42, and the fabric 40. Similarly, along the locations of the circumference of the loops 22, 24 which are not hingedly connected to a panel 26 or 28, sleeves 42 of the loops 22, 24 can be stitched to the fabric 40 in a manner similar to that illustrated in FIG. 2 (i.e., by applying a stitching).

The removable connections achieved by the attachment mechanisms described above can also act as hinges between adjacent side edges of adjacent panels. The difference between the removable connections and the hinge connections is that the removable connections can be detached without destroying the ability of re-attaching the connection using the same attachment mechanism.

Openings (not shown) may be provided in some or all of the panels 26, 28 and loops 22, 24. These openings may be of any shape (e.g., triangular, circular, rectangular, square, diamond, etc.) and size and are designed and dimensioned to allow the user to crawl through them to enter or to exit the structure 20. As explained above, the loops 22, 24 can have no fabric 46 so that a tunnel-like structure 20 is provided for a person 54 to crawl therethrough.

Figure 4:
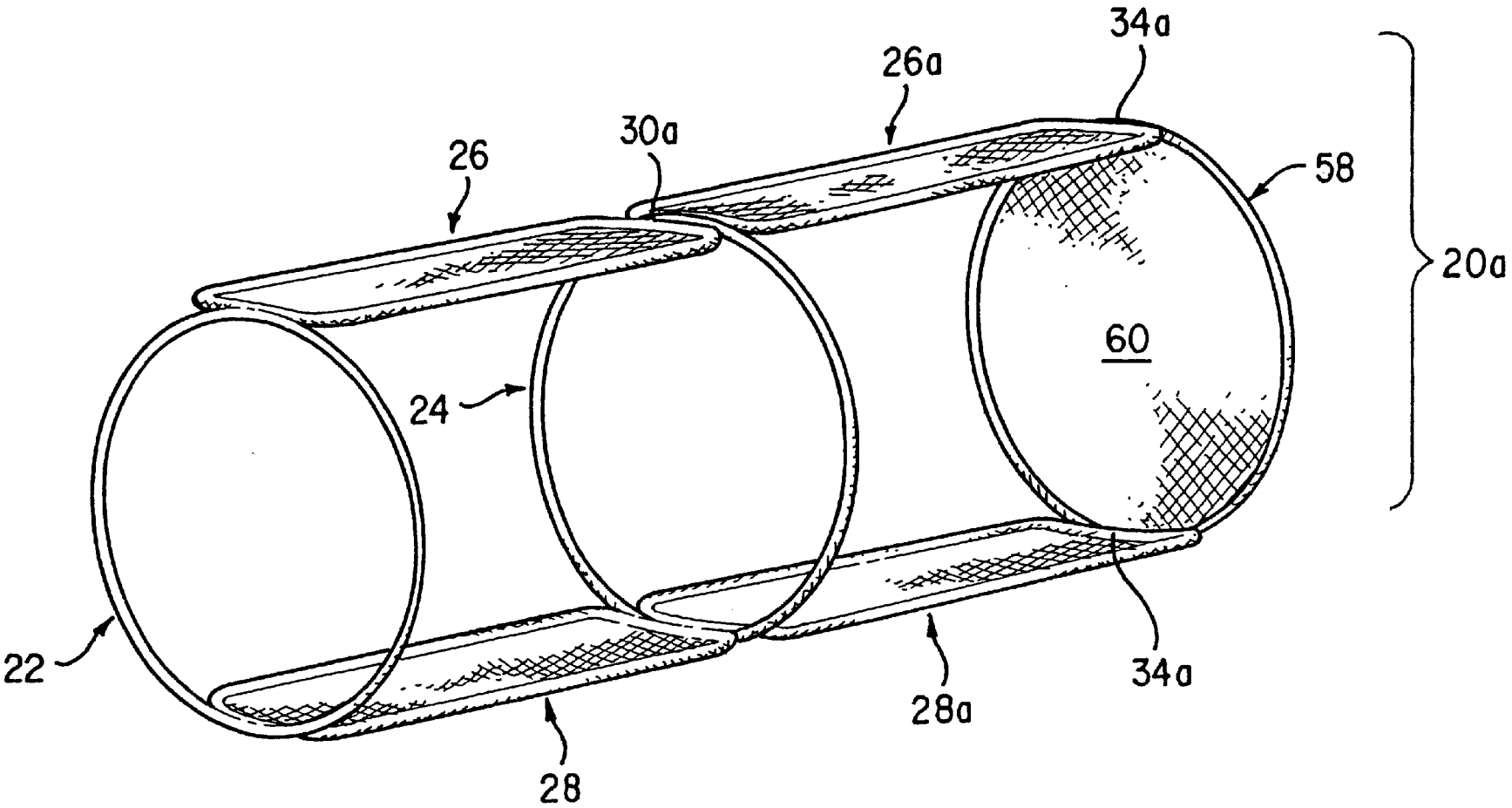
FIG. 4 is a perspective view of a collapsible structure according to another embodiment of the present invention.

FIG. 4 illustrates a structure 20*a* that includes modifications that can be made to the structure 20. First, the structure 20*a* has essentially the same construction as structure 20, with the panels 26, 28 and loops 22, 24 connected in the same manner described above. However, the fabric pieces 40 are omitted. In addition, two additional panels 26*a* and 28*a* (which can be the same in construction as panels 26 and 28, respectively) are hingedly or removably connected at their first ends 30*a* to the loop 24, and are hingedly or removably connected at their second ends 34*a* to a third loop 58 according to the principles described above. The panels 26*a* and 28*a* are positioned to be in the same general plane as panels 26 and 28, respectively. The third loop 58 can be the same as loops 22, 24, except that a fabric 60 can extend across the entire space defined by the third loop 58. Thus, the structure 20*a* defines an extended path or tunnel that has a closed end that is defined by the third loop 58.

Figure 5A:
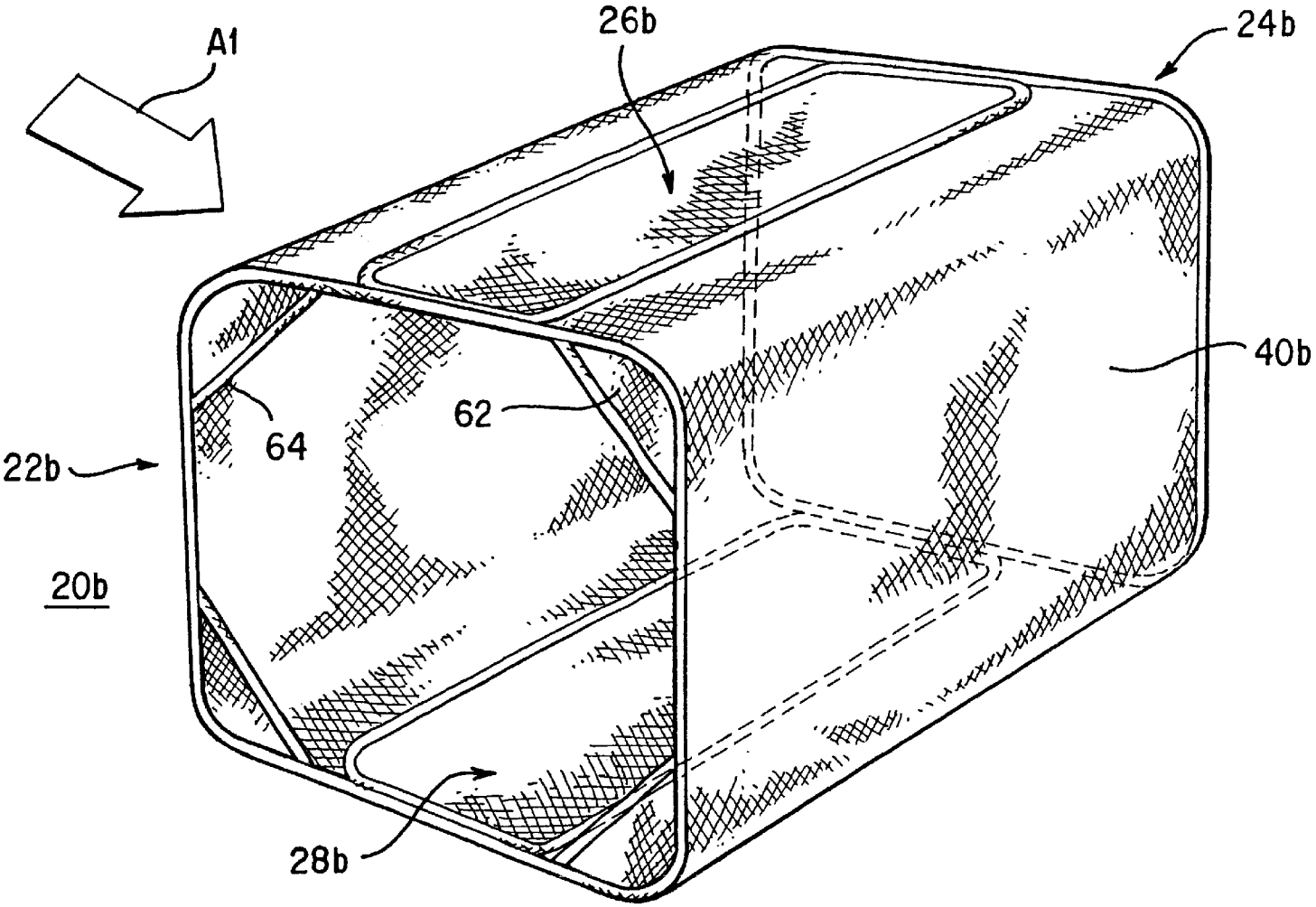
FIG. 5A is a perspective view of a collapsible structure according to yet another embodiment of the present invention.
Figure 5B:
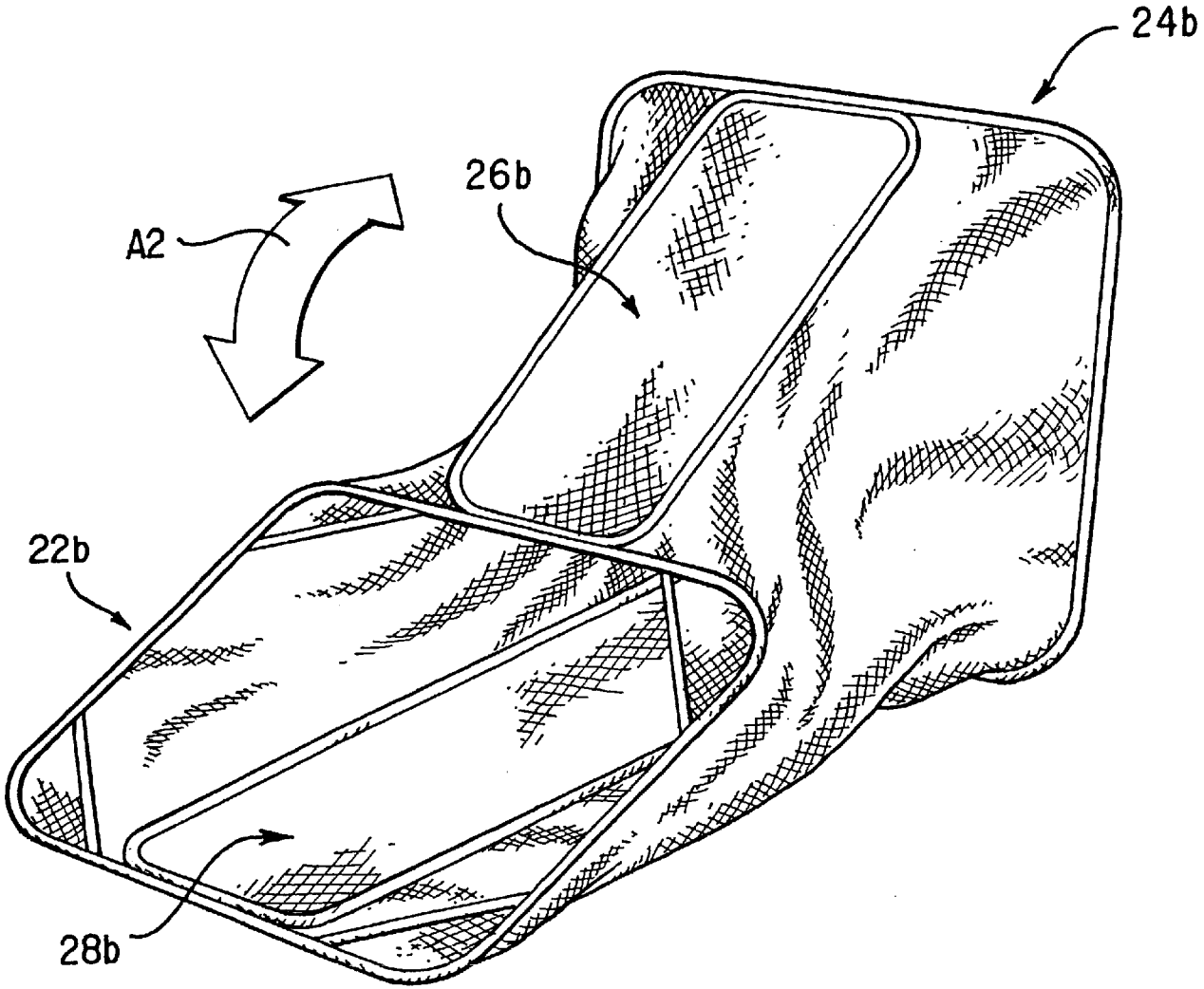
FIGS. 5B through 5E illustrate how the structure of FIG. 5A may be twisted and folded for compact storage.

FIG. 5A illustrates another structure 20*b* that includes other modifications that can be made to the structure 20. First, the structure 20*b* has essentially the same construction as structure 20, with panels 26*b*, 28*b* and loops 22*b*, 24*b* being the same as panels 26, 28 and loops 22, 24 and connected in the same manner described above, except that the loops 22*b*, 24*b* have a four-sided configuration, and panels 26*b* and 28*b* are smaller than panels 26 and 28, respectively. A corner fabric piece 62 is provided at each corner of each loop 22*b*, 24*b*, and function to provide the loop 22*b*, 24*b* with a predefined configuration. For example, if corner pieces 62 were omitted from the loop 22*b* and the loop 22*b* was large, the resilient nature of the frame member 44 may cause the loop 22*b* to coil into an undefined shape. Therefore, providing four corner pieces 62 as shown in FIG.

5A would define a generally square or rectangular loop 22*b*, providing three corner pieces 62 would define a generally three-sided loop 22*b*, and so on. The corner pieces 62 can be provided in the form of a fabric corner piece 62, a strap or string (see 64) having opposing ends connected to adjacent sides of the loop 22*b*, or other similar mechanisms. Fabric 40*b* similar to fabric 40 in FIG. 1 can be provided and stitched to the sides of the panels 26*b*, 28*b* and loops 22*b*, 24*b*, and used to define side walls for the structure 20*b*.

FIGS. 5A through 5E describe the steps for disassembling and collapsing the structure 20*b* into a compact configuration for storage. In the first step shown in FIG. 5A, the user simultaneously pushes the panel 26*b* and the loop 22*b* in the direction of arrow Al against the loop 24*b* and the panel 28*b*, respectively, about the hinged connections. The panel 28*b* and the loop 22*b* are then folded about the hinge connections so that the stack of panel 28*b* and loop 22*b* is folded onto and overlies the stack of panel 26*b* and loop 24*b*, so that the panels and loops now rest one on top of the other in a stack (see FIG. 5B), in the order of panel 28*b*, loop 22*b*, panel 26*b* and loop 24*b*, for example. The structure 20*b* is then ready to be twisted and folded to collapse the frame members and corresponding panels and loops into a smaller shape.

Figure 5C:
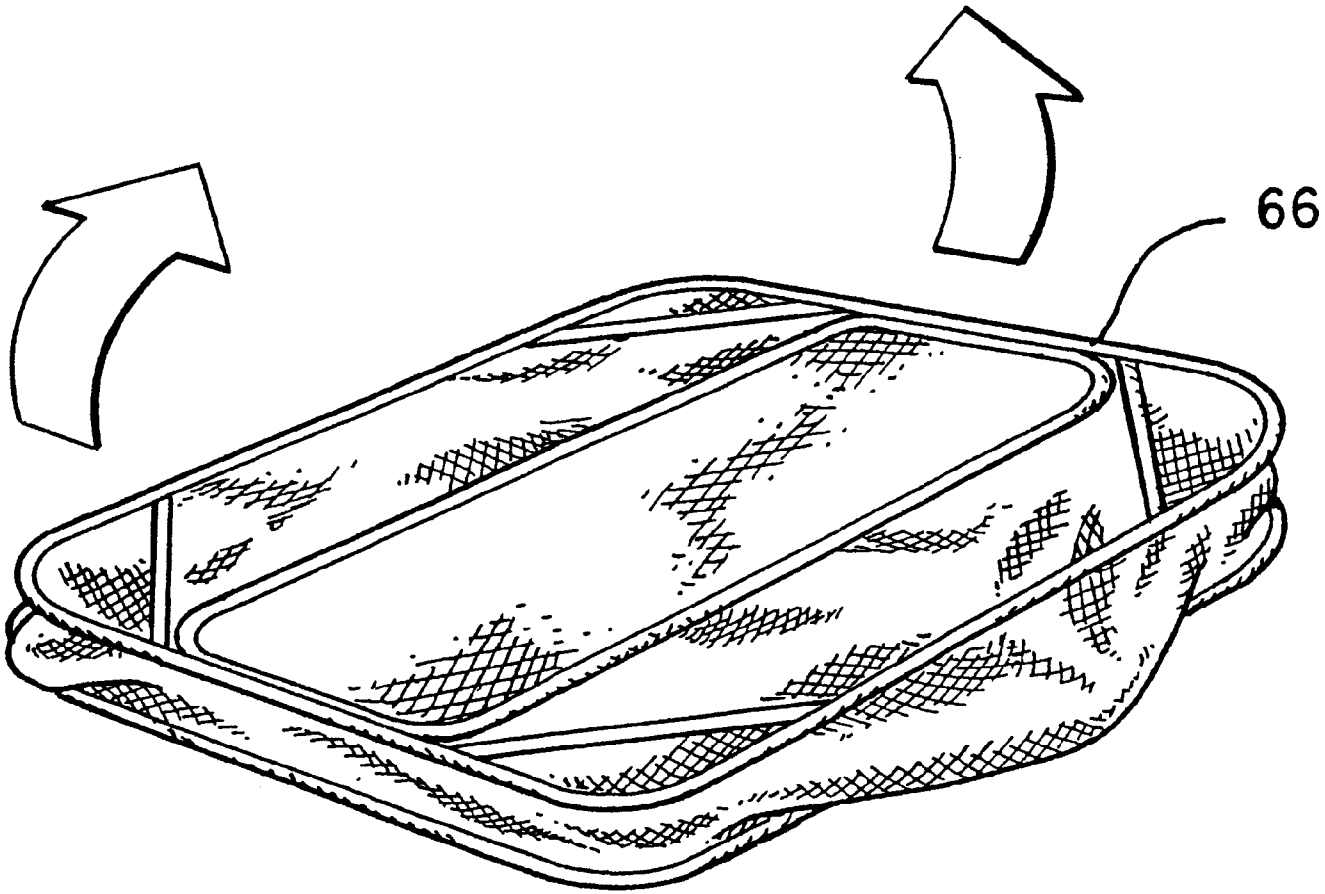
Figure 5D:
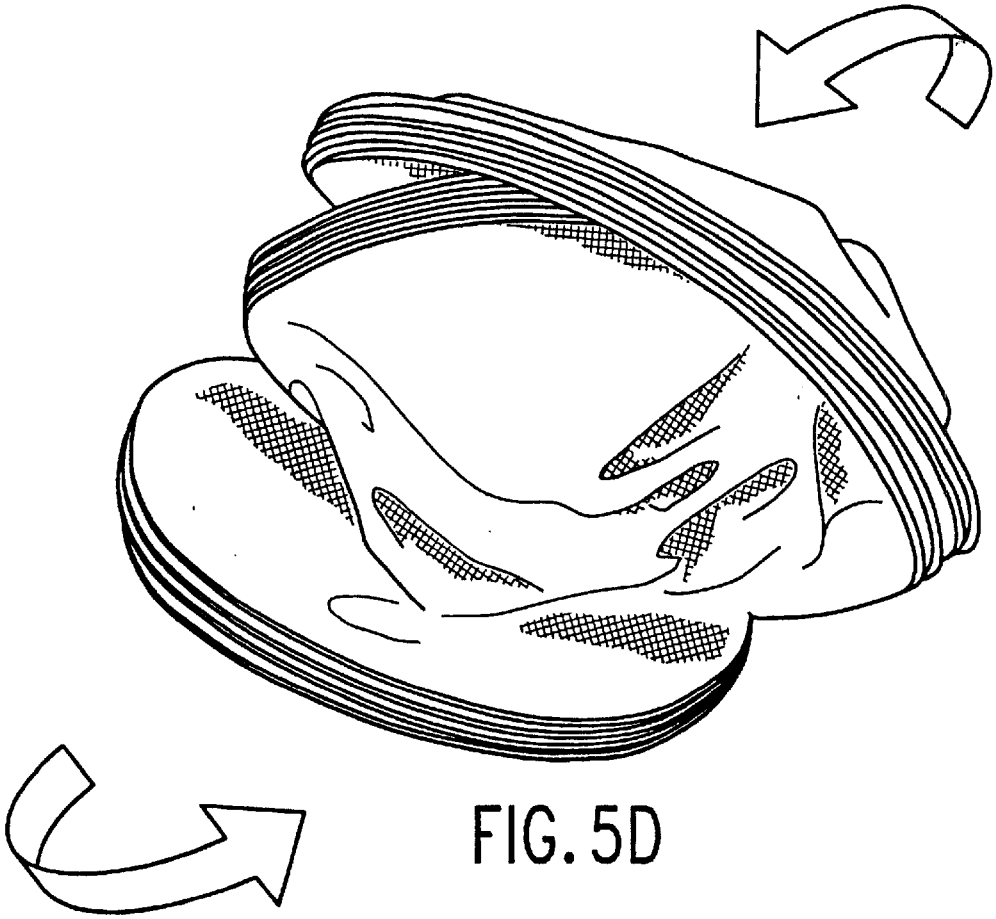
Figure 5E:
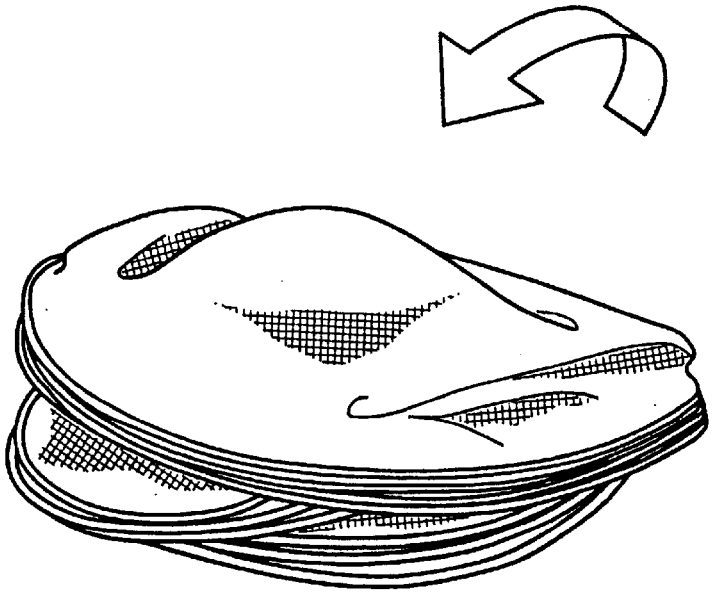

In the next step shown in FIG. 5C, the opposite border 66 of the structure 20*b* is folded in upon the previous fold to further collapse the frame members with the panels and loops. As shown in FIG. 5D, the next step is to continue the collapsing so that the initial size of the structure is reduced. FIG. 5E shows the next step with the frame members, panels and loops collapsed on each other to provide for a small essentially compact configuration having a plurality of concentric frame members and fabric layers of the panels and loops so that the collapsed structure has a size which is a fraction of the size of the initial structure.

The same principles illustrated in FIGS. 5A–5E can be used to fold and collapse all the other structures illustrated herein.

Figure 6:
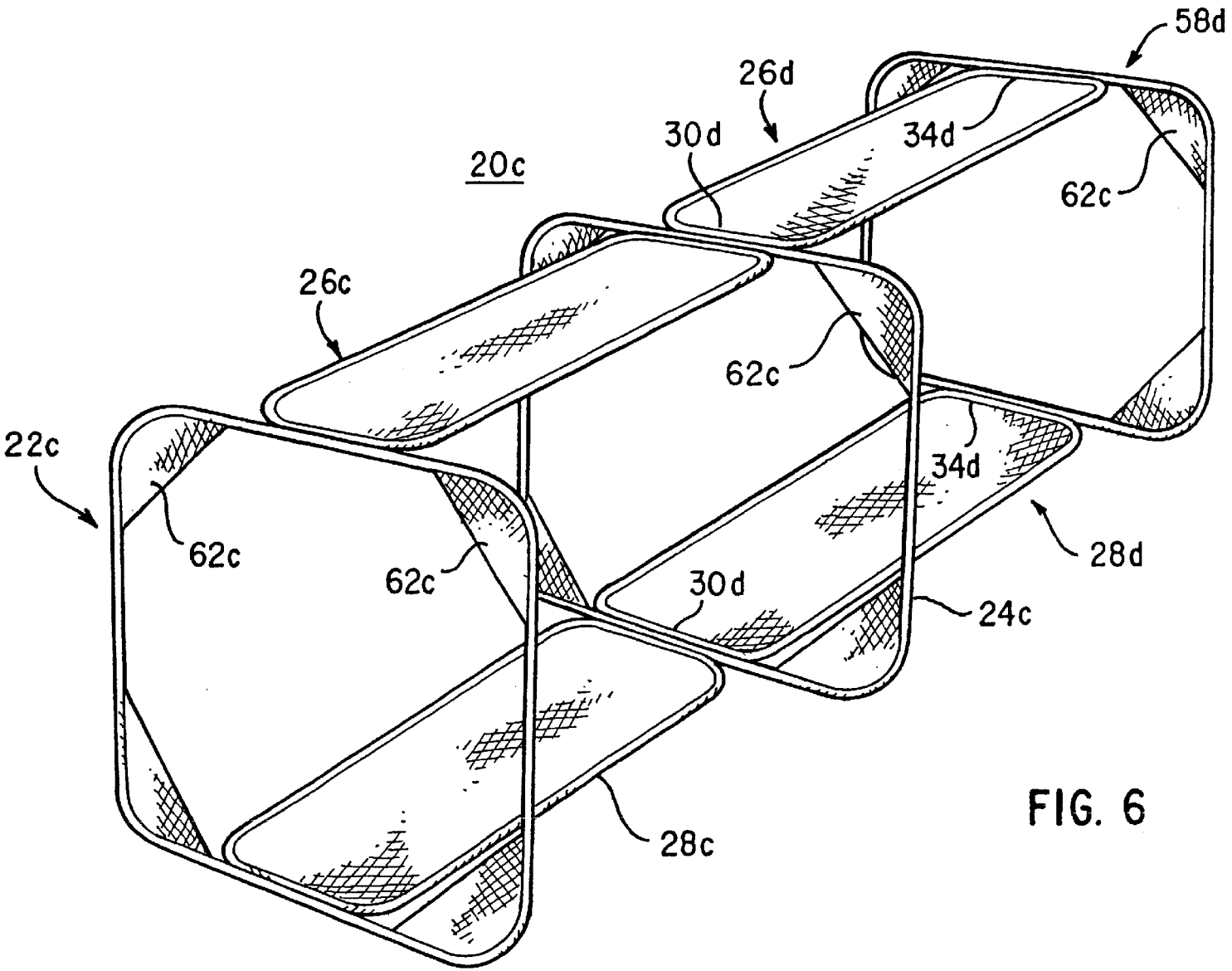
FIGS. 6–8 are perspective views of collapsible structures according to further embodiments of the present invention.
Figure 7:
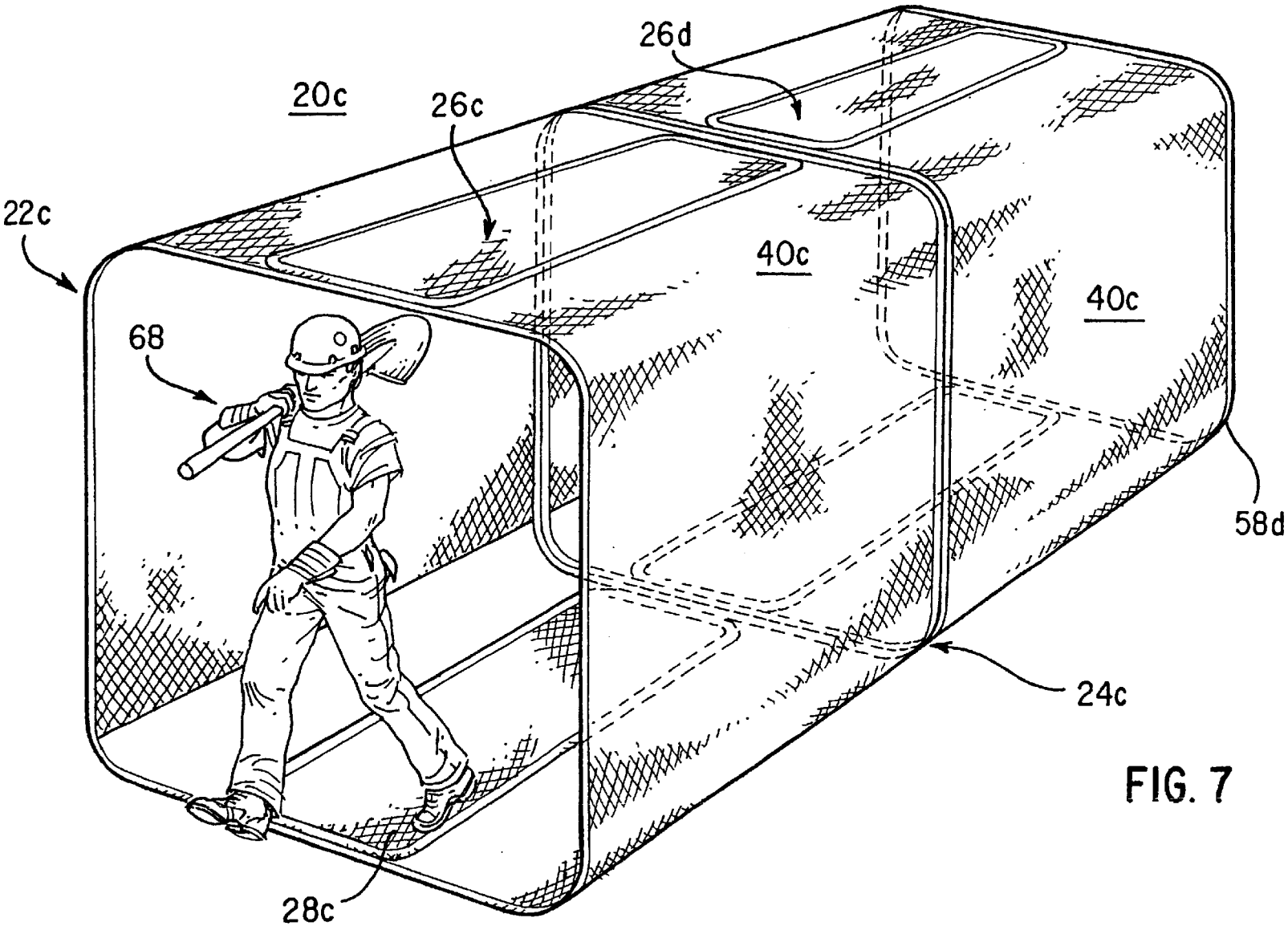

FIG. 6 illustrates a structure 20*c* that includes modifications that can be made to the structure 20*b*. First, the structure 20*c* has essentially the same construction as structure 20*b*, with the panels 26*c*, 28*c* and loops 22*c*, 24*c* connected in the same manner described above. However, the fabric pieces 40*b* are omitted. In addition, two additional panels 26*d* and 28*d* (which can be the same in construction as panels 26*c* and 28*c*, respectively) are hingedly or removably connected at their first ends 30*d* to the loop 24*c*, and are hingedly or removably connected at their second ends 34*d* to a third loop 58*d* according to the principles described above. The third loop 58*d* can be the same as loops 22*c*, 24*c*. The panels 26*d* and 28*d* are disposed in the same general plane as panels 26*c* and 28*c*, respectively. Thus, the structure 20*d* is similar to structure 20*a* in that it defines an extended path or tunnel. FIG. 7 shows the same structure 20*c* with the side fabric pieces 40*c* stitched to the panels and loops, so that the structure 20*c* can be used as a covered passageway or tunnel by workers 68 or for other purposes.

The structure 20*c* can be folded and collapsed by simultaneously pushing the panel 26*c* and the loop 22*c* against the loop 24*c* and the panel 28*c*, respectively, about the hinged connections. The panel 28*c* and the loop 22*c* are then folded about the hinge connections so that the stack of panel 28*c* and loop 22*c* is folded onto and overlies the stack of panel 26*c* and loop 24*c*. Thereafter, the panel 26*d* and the loop 58*d* can be simultaneously pushed against the loop 24*c* and the panel 28*d*, respectively, about the hinged connections. The panel 28*d* and the loop 58*d* are then folded about the hinge connections so that the stack of panel 28*d* and loop 58*d* is folded onto and overlies the stack of panel 26*d* and loop 24*c*. This will form one stack of panels and loops that include the panels and loops in one possible order: 28*c*, 22*c*, 26*c*, 24*c*, 26*d*, 58*d* and 28*d*. The principles of FIGS. 5C–5E can then be used to twist and fold this stack of panels and loops.

Figure 8:
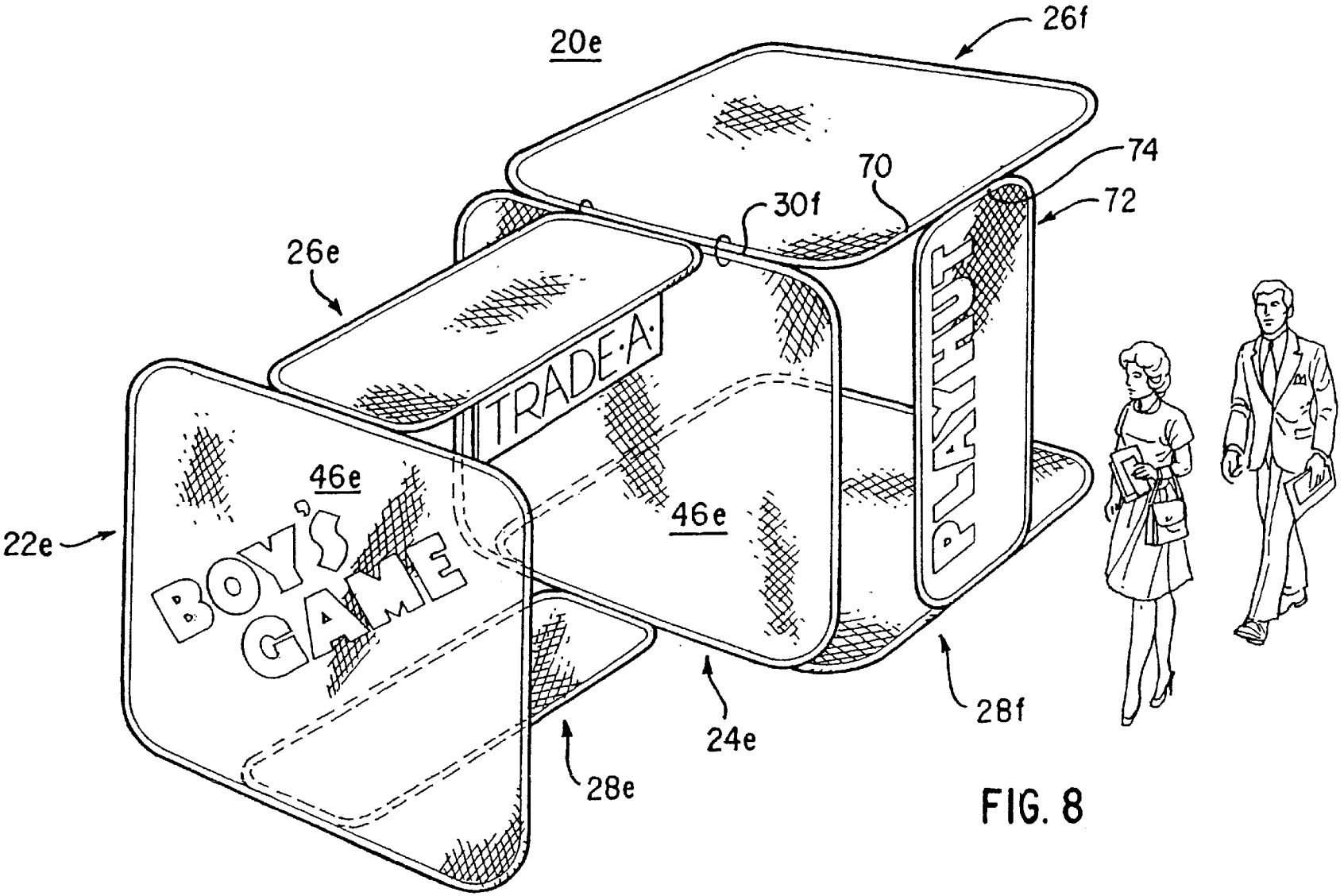

FIG. 8 illustrates a structure 20*e* that includes modifications that can be made to the structure 20*c*. First, the structure 20*e* also has the panels 26*e*, 28*e* and loops 22*e*, 24*e* connected in the same manner described above as for the panels 26*c*, 28*c* and loops 22*c*, 24*c*. However, each loop 22*e*, 24*e* is completely covered by fabric 46*e* so that each loop 22*e*, 24*e* becomes a panel. In addition, two additional panels 26*f* and 28*f* (which can be the same in construction as panels 26*e* and 28e, respectively, except that panels 26*f* and 28*f* can be larger) are hingedly or removably connected at their first ends 30*f* to the loop 24*e*, and are hingedly or removably connected at a side edge 70 to a side panel 72 according to the principles described above. The side panel 72 can have the same construction as any of the other panels 26*e*, 26*f*, 28*e*, or 28*f* and essentially performs the function of the loop 58*d* to hold up and space apart the panels 26*f*, 28*f*. Thus, the structure 20*e* can be used as partitions, or exhibits for use in exhibiting items, or other similar applications.

The structure 20*e* can be folded and collapsed by using the same principles for folding and collapsing structure 20*c*. The only difference is that one of the hinged connections for the panel 72 is a removable connection. For example, the top side 74 of the panel 72 is removably connected to the side edge 70 of the panel 26*f*, so that the removable connection can be detached and the panel 72 folded on to panel 28*f*. The panel 26*f* and the stack of panels 28*f* and 72 can then be folded against the panel 24*e*, and the folding and collapsing principles for the structure 20*c* applied to complete the folding and collapsing of the structure 20*e*.

Figure 9:
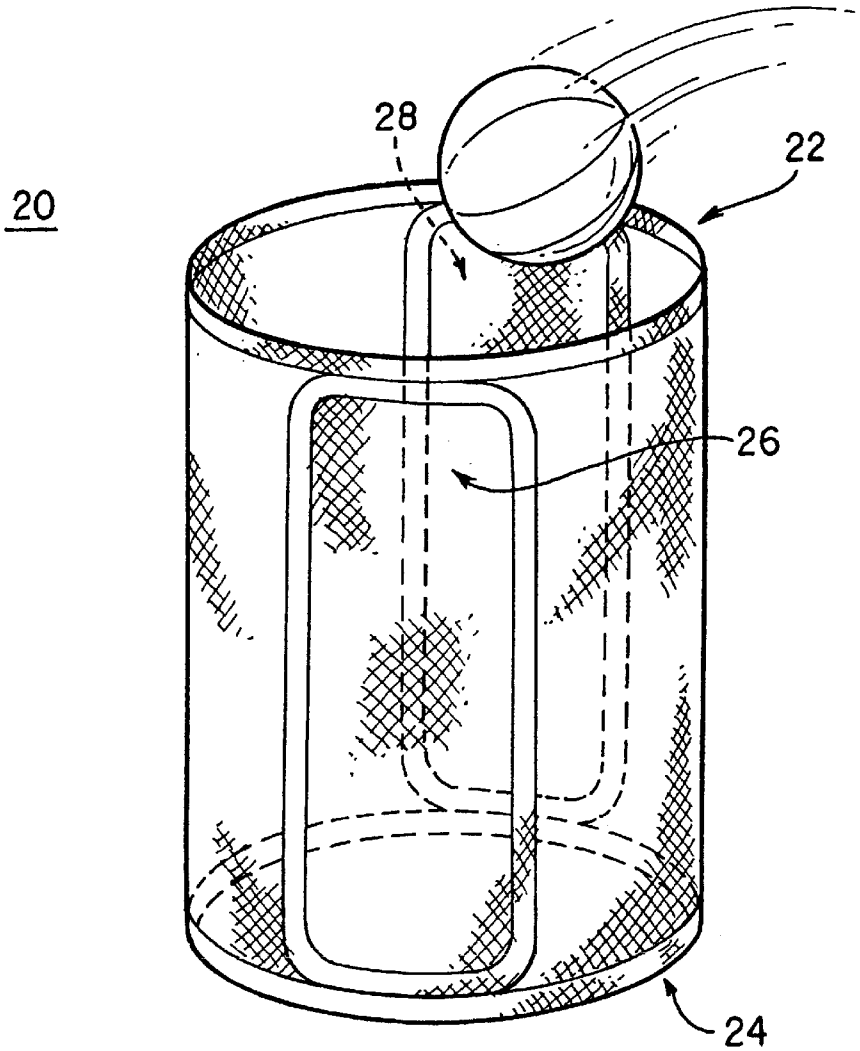
FIG. 9 illustrates a different way of deploying the structure FIG. 1 for use.

The structures illustrated in FIGS. 1–8 can be oriented differently to facilitate different uses of these structures. For example, the structure 20 is shown in FIG. 1 as a tunnel, but can be oriented differently as shown in FIG. 9 for use as a basket or bin. In FIG. 9, the loop 24 can be completely covered with fabric, and the loop 24 placed on the floor or a surface, so that the panels 26, 28 and the fabric 40 together form the circumferential or side wall for a container 20. The loop 22 can have no fabric, so that the loop 22 can function as an opening to the container 20 in FIG. 9.

Figure 10:
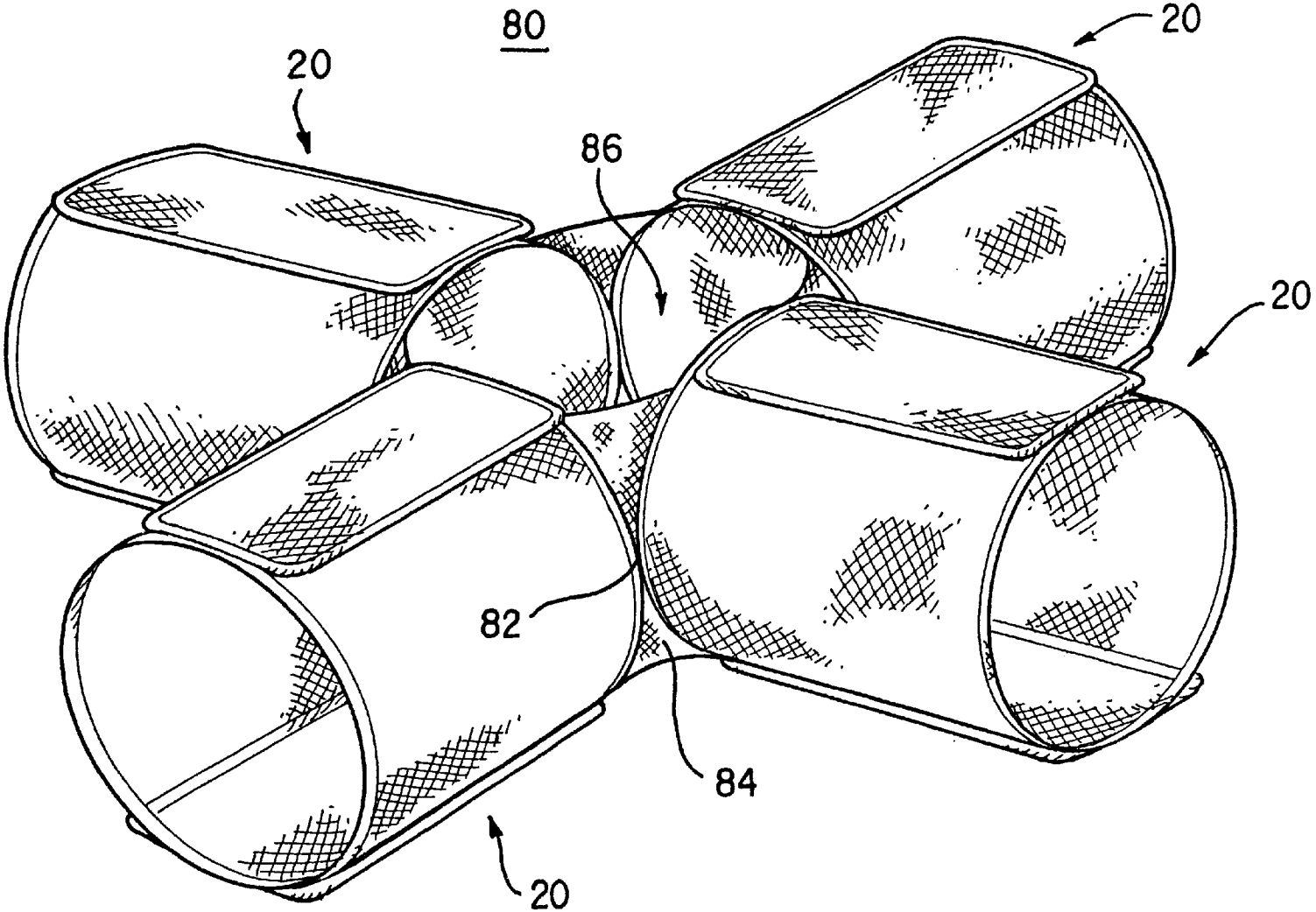
FIG. 10 illustrates one way in which a plurality of the structures of FIG. 1 can be deployed for use.

Each of the structures 20 and 20*b* in FIGS. 1 and 5A, respectively, can be combined together with other similar structures to form assembled structures that have a variety of shapes and sizes, as well as a variety of applications and uses. FIGS. 1, 4, 6 and 8 have already illustrated some possible resulting combined structures. FIG. 10 illustrates another possible way in which a plurality of the structures of FIG. 1 can be combined to create different resulting structures. In FIG. 10, the resulting structure 80 has four structures 20 that are combined to form a cross-shaped structure 80. The loops 24 of each adjacent structure 20 are stitched or removably connected to each other (such as at location 82), and additional fabric 84 can even be stitched to the loops 24 at these connections 82 to enclose an interior space 86 that is defined by the four loops 24. The structure 80 can be folded and collapsed in the following manner. First, the steps shown in FIGS. 5A–5C can be carried out so that each structure 20 becomes a stack of four panels and loops. At this time, the structure 80 will have four side walls that together define the interior space 86, with each of the four side walls made up of a separate stack of four panels and loops. The steps shown in FIGS. 5A–5C can then be applied to these four side walls to obtain a singular stack of sixteen panels and loops, which can be twisted and folded together according to the steps shown in FIGS. 5C–5E.

Figure 11:
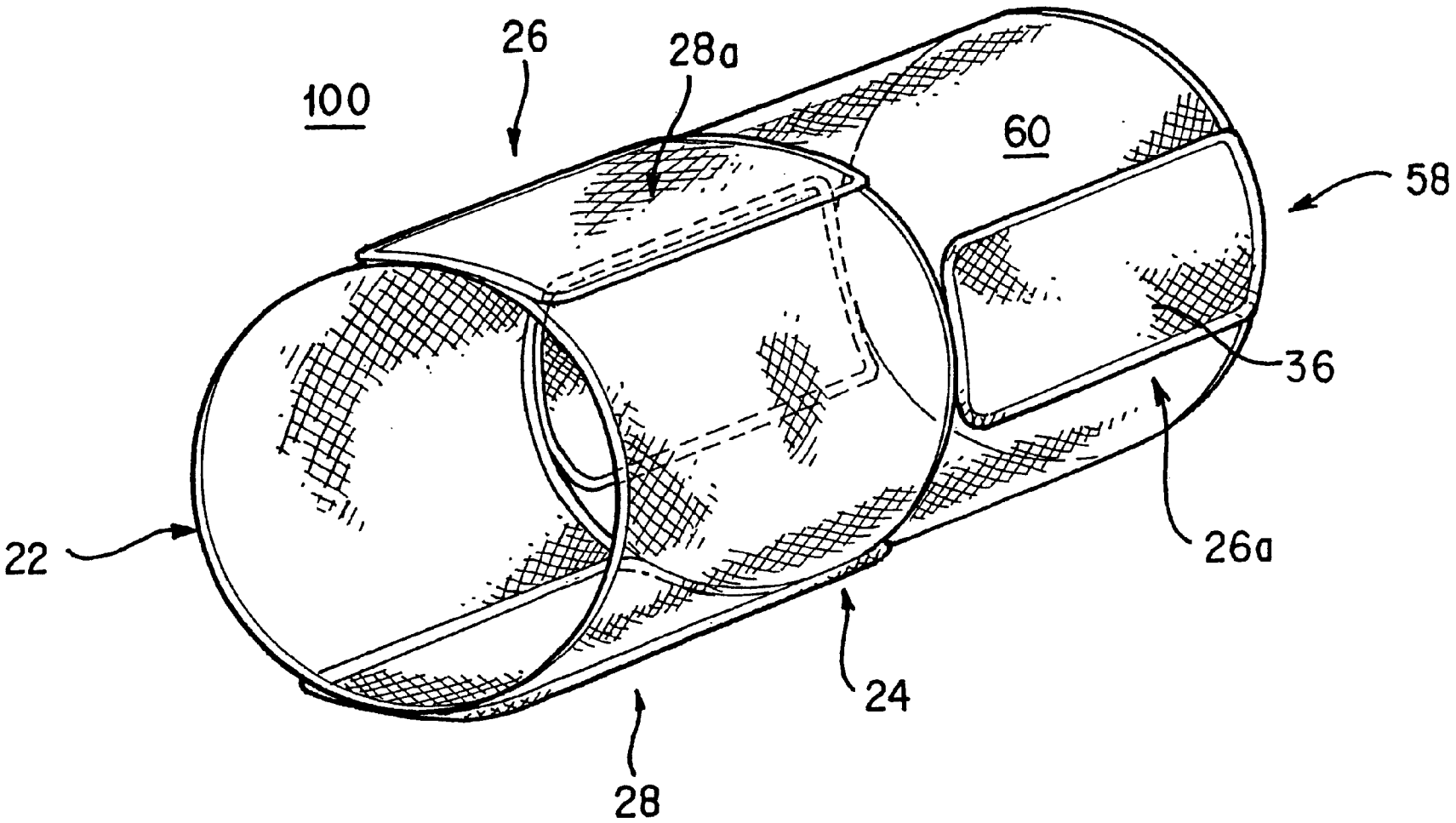
FIGS. 11–13 are perspective views of collapsible structures according to further embodiments of the present invention.

FIG. 11 illustrates a structure 100 that includes modifications that can be made to the structure 20*a*. First, the structure 100 has essentially the same construction as structure 20*a*, except that the panels 26*a* and 28*a* are now disposed out of phase with respect to the panels 26 and 28 by about ninety degrees. The configuration shown in FIG. 11 provides several structural benefits. First, the planar nature of the panel 28 allows the entire structure 100 to be stably supported on a floor or surface when the panel 28 is placed flat on the floor or surface. Thus, the panels 26*a* and 28*a* can be used as side or wall panels. In addition, the lateral sides 36 of the panels 26*a*, 28*a* can be made to contact the floor or surface (by extending the length of the end sides 30, 34 of panels 26*a*, 28*a*), thereby providing greater structural stability for the structure 100. In addition, the structure 100 can be rotated by ninety degrees so that the panels 26 and 28 now function as the side or wall panels. As with structure 20*a* in FIG. 4, the fabric 60 can be omitted to provide a through-passageway for the tunnel structure 100.

Figure 12:
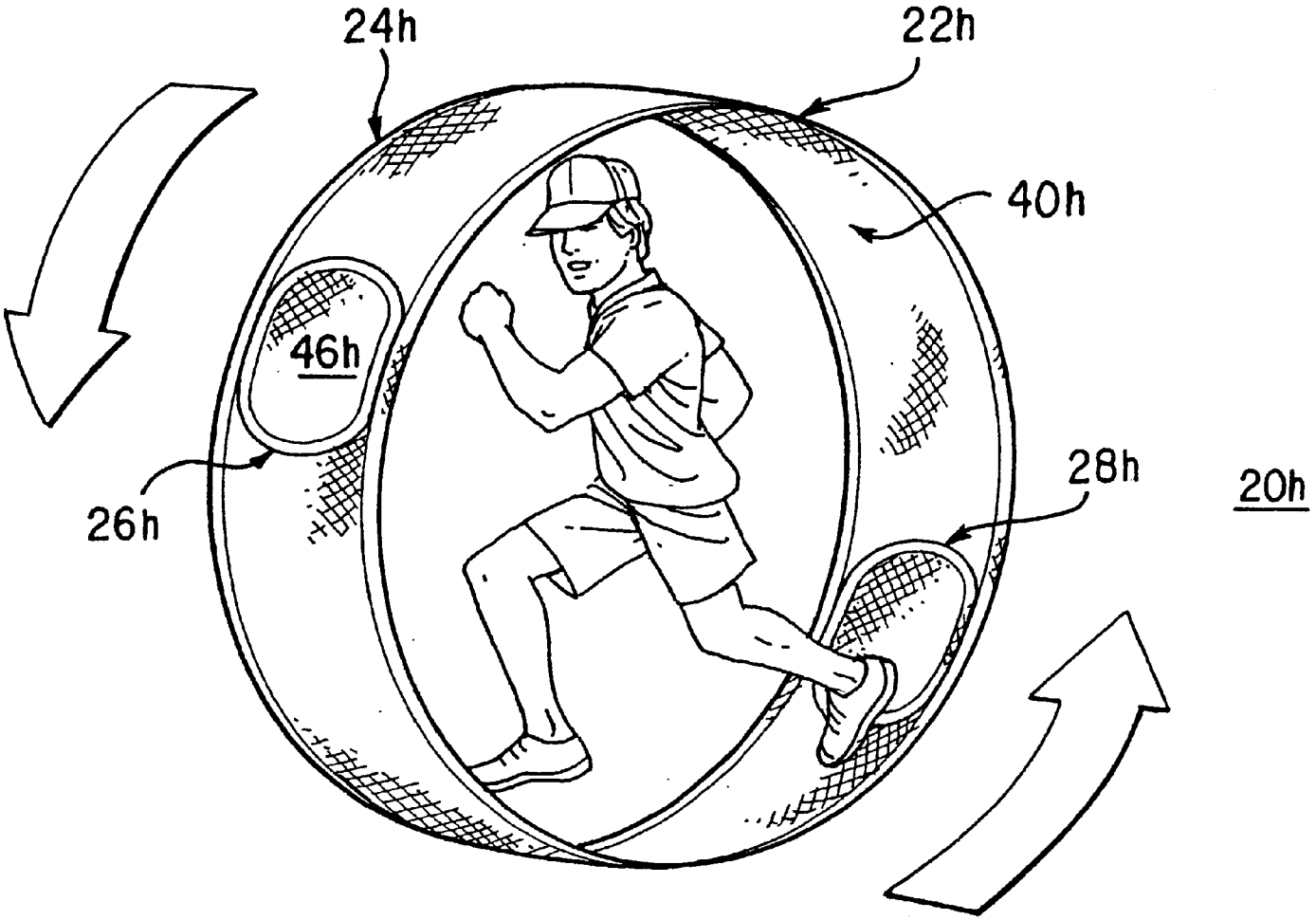
Figure 13:
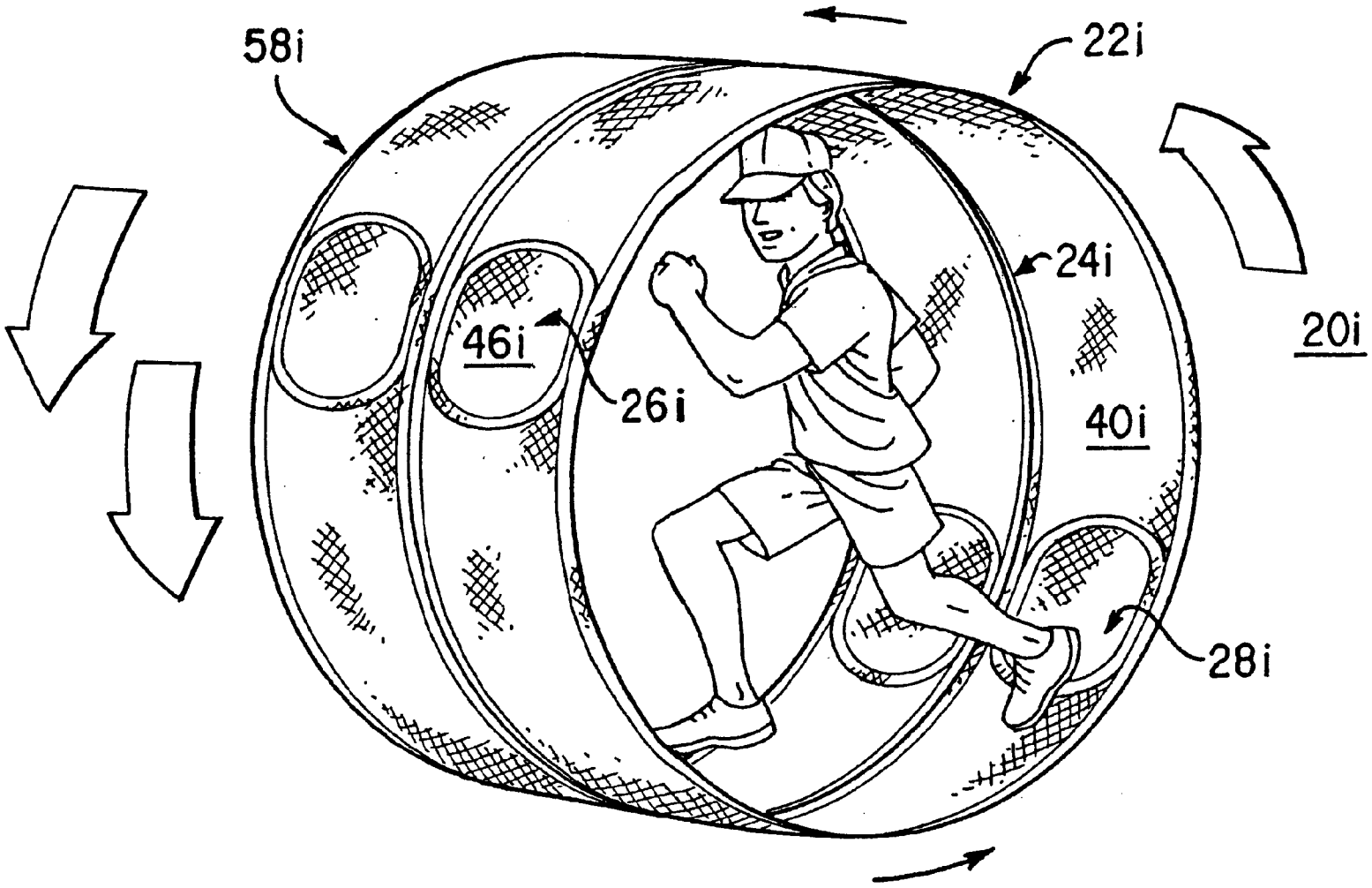

FIG. 12 illustrates how the structure 20 in FIG. 1 can be modified to be an exercise apparatus. In this regard, the structure 20*h* has essentially the same construction as structure 20, with the panels 26*h*, 28*h* and loops 22*h*, 24*h* connected in the same manner described above. However, the loops 22*h*, 24*h* are made to be larger, and the panels 26*h*, 28*h* smaller, than their counterparts in structure 20. Thus, the structure 20*h* itself becomes a rotating loop having a width defined by the panels 26*h*, 28*h*, and with the fabric 40*h* and 46*h* forming a track for the rotating structure 20*h*. FIG. 13 illustrates how the principles of structure 20*h* in FIG. 12 can be extended to the structure 20*a* of FIG. 4, where the three loops 22*i*, 24*i* and 58*i* and their corresponding fabrics 40*i* and 46*i* define the track for the rotating structure 20*i*. The structures 20*h* and 20*i* can be folded and collapsed using the same principles illustrated above in FIGS. 5A–5E.

While some of the structures are described as having hinged connections and no removable connections, it is possible to provide one or more of the hinged connections as removable connections. The removable connections can be achieved by the attachment mechanisms described above. To fold and collapse a structure having panels and loops connected by removable connections, the user merely removes these connections, and then folds and/or places the panels and loops one on top of the other so that the panels and loops of the structure overlie one another to form one stack of panels and loops. The combined stack of panels and loops is then twisted and folded in the manner described above in connection with FIGS. 5C–5E to collapse the structure into a compact configuration.

Throughout this disclosure, the use of the same numeral (with different alphabetic letters "a", "b", "c", etc. following these numerals) in different embodiments and FIGS. is intended to mean that the elements sharing these same numerals have the same structure, construction or features, except for the differences pointed out herein. Therefore, additional descriptions of these elements in subsequent embodiments are not provided.

Thus, the structures according to the present invention may be provided in a variety of configurations in which the number of panels and loops, and the shape and size of the panels and loops, may be varied. As a result, the structures according to the present invention can be used for a variety of different applications. The structures according to the present invention can be easily deployed and disassembled, and are easy to fold and collapse into a compact configuration for convenient storage or transportation.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a panel having separate first and second locations, separate first and second sides that are separate from the first and second locations, a foldable frame member having a folded and an unfolded orientation, and a fabric material covering portions of the frame member to form the panel when the frame member is in the unfolded orientation;

first and second loops, each loop having a periphery and a foldable frame member that has a folded and an unfolded orientation, with the first location of the panel coupled to the first loop, and the second location of the panel coupled to the second loop; and a material coupled to portions of the peripheries of the first and second loops, and to portions of the first and second sides to define a space between the panel, the first loop and the second loop.

2. The structure of claim 1, wherein the panel is a first panel, and further including a second panel having a first location coupled to the first loop, and a second location coupled to the second loop, with the first panel and the second panel spaced-apart from each other, the second panel also having a foldable frame member having a folded and an unfolded orientation, and a fabric material covering portions of the frame member of the second panel to form the second panel when the frame member of the second panel is in the unfolded orientation.

3. The structure of claim 2, wherein the first panel and the second panel are generally parallel to each other.

4. The structure of claim 1, wherein the first and second loops are spaced apart from and generally parallel to each other.

5. The structure of claim 1, wherein the material is a fabric that is coupled to the panel and the first and second loops.

6. The structure of claim 1, wherein the panel is a first panel, the structure further including:

a third loop having a foldable frame member having a folded and an unfolded orientation, the third loop spaced apart from the second loop;

a second panel comprising separate first and second locations, a foldable frame member having a folded and an unfolded orientation, and a fabric material covering portions of the frame member to form the second base panel when the frame member is in the unfolded orientation; and wherein the first location of the second panel is coupled to the second loop, and the second location of the second panel is coupled to the third loop.

7. The structure of claim 6, further including:

a third panel having a first location coupled to the first loop, and a second location coupled to the second loop, with the first panel and the third spaced-apart from each other; and a fourth panel having a first location coupled to the second loop, and a second location coupled to the third loop, with the second panel and the fourth panel spaced-apart from each other; and wherein each of the third and fourth panel has a foldable frame member having a folded and an unfolded orientation, and a fabric material covering portions of the frame member of the corresponding panel.

8. The structure of claim 7, further including a fabric that is coupled to the first, second, third and fourth panels, and the first, second and third loops.

9. The structure of claim 7, wherein the second panel and the fourth panel are disposed out of phase with the first panel and the third panel.

10. The structure of claim 1, wherein the structure is a first structure, and further including a second identical structure, with the first loop of each of the first and second structures coupled together.

* * * * *